US005449158A

United States Patent [19]

Hirota et al.

[11] Patent Number: 5,449,158

[45] Date of Patent: Sep. 12, 1995

[54] SORTER FOR DISTRIBUTING A PLURALITY OF SHEETS TO A PLURALITY OF SHEET HOLDING BINS

[75] Inventors: Kazuhiro Hirota; Keisuke Tanaka; Izumi Hamanaka; Minoru Kawano; Hisao Hosoya; Akihiko Nishiki, all of Hachioji, Japan

[73] Assignee: Konica Corporation, Tokyo, Japan

[21] Appl. No.: 83,100

[22] Filed: Jun. 25, 1993

[30] Foreign Application Priority Data

Jul. 3, 1992 [JP] Japan ..... 4-176910

[51] Int. Cl.[6] ..... B65H 39/02

[52] U.S. Cl. ..... 270/58; 271/296

[58] Field of Search ..... 271/296, 303; 270/58

[56] References Cited

U.S. PATENT DOCUMENTS

| | | | |
|---|---|---|---|
| 3,561,753 | 2/1971 | Snellman | 271/296 X |
| 3,765,670 | 10/1973 | Johnson | 271/296 |
| 3,853,314 | 12/1974 | Anderson | 270/58 X |
| 4,200,278 | 4/1980 | Gindri | 271/296 |
| 4,285,508 | 8/1981 | Kaneko | 271/296 X |
| 4,548,403 | 10/1985 | Matsui et al. | 271/296 |
| 4,561,647 | 12/1985 | Snellman et al. | 271/296 |
| 4,678,180 | 7/1987 | Tamura et al. | 271/296 |
| 4,776,580 | 10/1988 | Honma | 271/296 |
| 4,822,024 | 4/1989 | Takahashi | 271/296 |
| 4,836,529 | 6/1989 | Kosaka et al. | 271/296 |
| 5,172,908 | 12/1992 | Steinhilber | 271/296 X |
| 5,192,066 | 3/1993 | Steinhilber | 271/296 X |

FOREIGN PATENT DOCUMENTS

| | | | |
|---|---|---|---|
| 0158556 | 6/1990 | Japan | 271/296 |

*Primary Examiner*—John E. Ryznic

*Attorney, Agent, or Firm*—Frishauf, Holtz, Goodman, Langer & Chick

[57] ABSTRACT

A sorter distributes plural sheets to plural sheet holding bins. The sorter includes the plural sheet holding bins for holding the plural sheets, in which inserting portions of the plural sheet holding bins are aligned in a line in a predetermined direction; a conveyance belt for conveying the plural sheets along the line; a distributor, that is reciprocally movable along the line, for distributing the plural sheets to the plural sheet holding bins; motorized pulleys for winding and unwinding a wire member; the wire member being connected between the motorized pulleys and the distributor; nipping apparatus for nipping and for conveying each of the plural sheets, the nipping apparatus being positioned between the conveyance belt and the wire member.

6 Claims, 7 Drawing Sheets

SORTER FOR DISTRIBUTING A PLURALITY OF SHEETS TO A PLURALITY OF SHEET HOLDING BINS

BACKGROUND OF THE INVENTION

The present invention relates to a conveyance means of a sorter which is combined with an image forming apparatus such as a copier or printer, and by which recording sheets delivered from the apparatus are conveyed and sorted.

Generally, the sorter is combined with an image forming apparatus 100 as shown in FIG. 4, and recording sheets 101 delivered from the apparatus 100 are sequentially conveyed and accommodated in a plurality of bins 51 provided in the sorter 10 by a conveyance means and, for example, a switching gate provided in the conveyance section of the sorter. Then, the recording sheets are separated into a specified number of groups.

In a fixed bin sorter, there are two types of sheet distributing methods, one is a method by which recording sheets are distributed into bins by a switching gate, and the other is a method by which the recording sheets are distributed into bins by a distributor (an indexer). The method by the indexer is superior to the other method in cost, and recently is mainly used.

In the method in which the sheets are distributed by the distributor, as the typical prior art of methods to convey sheets, there are two examples as follows.

One is the method in which the sheet is sandwiched between a thin plate spring and a conveyance belt, and then conveyed. The other is the method in which the recording sheet is pressed by a sheet guide, such as a Mylar sheet guide, and a conveyance belt, and then conveyed.

Referring to the drawings, the foregoing two methods will be described as follows.

In the method in which the recording sheets are distributed to bins by switching gates, the switching gates 15*a*, 15*b*, . . . 15*n* are provided along a conveyance belt 12, and bins 51*a*, 51*b*, . . . 51*n* corresponding to the switching gates are provided as shown in FIG. 5. The recording sheets are conveyed while being sandwiched between the conveyance belt 12 and conveyance rollers 14. For example, in the case where the recording sheet is sent to the bin 51*b*, the switching gate 15*b* is turned to the position of 15*b*1 in FIG. 5 by a mechanism not shown in the drawing, and the recording sheet is sent to the bin 51*b* in the arrowed direction.

That is, the switching gates 15 are provided one by one corresponding to each of bins 51, and when the switching gates sequentially turn their directions, the recording sheets are sequentially sent to the bins 51 corresponding to each of switching gates 15. As described above, in the foregoing method, the number of parts is large, and the structure becomes complicated.

On the other hand, in the method in which the recording sheet is distributed to each bin by the distributor, as shown in FIG. 6 or FIG. 7, the distributor is moved in the upper and lower directions along the conveyance belt 12 by a mechanism not shown in the drawings.

The recording sheet is sandwiched between the conveyance belt 12 and a thin plate spring 35, or between the conveyance belt 12 and the sheet for guide 35*a* such as a Mylar sheet guide, or pressed by them, and then, conveyed. The recording sheets are successively sent to each of bins 51 in the arrowed direction by the distributor 21 which stops at each position corresponding to bins 51.

That is, in the distributor 21, a moving member 34 having a couple of delivery rollers 30 can be moved in the upper and the lower directions by a mechanism not shown in the drawings, and can be successively stopped at the corresponding bins 51. The moving member 34 has a receiving port 23*a* and a delivery port 23*b*. The recording sheets are sent to the bins as follows: the recording sheets are sandwiched between the conveyance belt 12 and thin plate spring 35, or between the conveyance belt 12 and the sheet guide such as a Mylar sheet guide, or pressed by them for conveyance; the conveyed sheets are sent from the receiving port 23*a* to the distributor 21; and then the recording sheets are conveyed successively from the delivery port 23*b* to bins 51 corresponding to the position of the stopped distributor 21.

Further, there are two sheet conveyance methods in the above-described sheet distribution method, and the difference between them will be described as follows.

That is, in the method in which the recording sheet is sandwiched between the conveyance belt 12 and the thin plate spring 35 for conveyance, there are the following advantages in which: as shown in FIG. 6, the structure of the moving member 34 is simple; and the receiving port 23*a* and the delivery port 23*b* are necessarily formed by the delivery roller 30 and the conveyance belt 12 even when the receiving port 23*a* and the delivery port 23*b* are not newly or separately provided. On the other hand, the foregoing method has the following disadvantage in which: there is a problem in sheet conveyance property because the sheet conveyance force is given by the spring force of the thin plate spring. In the sheet conveyance method in which the sheet is pressed by the sheet guide 35*a*, such as a Mylar sheet guide, and the conveyance belt 12, its structure is simple as shown in FIG. 7, however, a countermeasure to prevent static electricity is necessary because the sheet guide is formed by the Mylar sheet, and there is a problem in maintenance.

As described above, there are various problems in the conventional methods, and therefore, a sufficient method can not be obtained.

That is, in the switching gate method, the number of parts is large, therefore the structure is complicated, the cost is high, and accordingly there is a possibility that problems are easily caused. Further, as a result of the foregoing, maintenance properties are deteriorated, and it is difficult to handle the apparatus.

Further, in the method using a distributor, when the thin plate spring is used, the conveyance force of the sheet depends on the spring properties of the thin plate spring, and therefore there are problems that the absolute value of the spring force is low, and the conveyance properties of the sheet are unstable.

In another method using the distributor in which a Mylar sheet is used, the sheet guide is formed by the Mylar sheet, so that the guide is apt to be electrostatically charged, and therefore, a discharging means should be especially considered. Since the conveyance belt is pressed from its inside, there is a case where it is necessary to remove the belt pressing device when jamming occurs. Therefore, it is necessary to provide a removal means by which the device can be easily removed, and the structure becomes complicated.

The present invention has been proposed to solve the foregoing problems. The object of the present invention is to provide a low cost sorter having the following advantages: a distributor method is provided, the cost of which is lower than that of the switching gate method; the conveyance force of the sheet is increased so that the sheet can be stably conveyed; the sheet is not electrostatically charged during conveyance; it is not necessary to provide a complicated structure to remove the pressing force by which the conveyance belt is pressed from the inside; and a sorter in which the structure is simple, the probability of failure is low, and the cost is low, can be provided.

SUMMARY OF THE INVENTION

The above-described object is accomplished by a sorter in which a conveyance belt is provided along inlet sides of plural bins, and a distributor which can be reciprocally moved vertically, is supported between the bins and the conveyance belt, the sorter being characterized in that: one end of a wire is provided to the distributor; a sheet is conveyed by being sandwiched between the conveyance belt and the wire, and a pulley, by which the other end of the wire is wound, is driven by the same driving system as that of the vertical movement of the distributor. Further, the above-described object is accomplished by a sorter in which a relative position of a plurality of wires provided for the conveyance belt are set on a sheet conveyance belt side of the conveyance belt.

The above-described object is also accomplished by a sorter in which a conveyance belt is provided along inlet sides of plural bins, and a distributor, which can be reciprocally moved vertically, is supported between the bins and the conveyance belt, the sorter comprising: pressing members, by which the conveyance belt is pressed from the inside of the conveyance belt, are provided at a position which is located at a conveyance belt side, and at a substantially central portion between upper and lower pulley shafts of the conveyance belt. Further, the above-described object is accomplished by a sorter in which the pressing force, by which the conveyance belt is pressed, with a force that is approximately equal to a force resulting from a resiliency created in the belt created by a deflection of the belt by the stiffness of the sheet when the conveyance direction of the sheet is changed by the distributor.

DETAILED DESCRIPTION OF THE INVENTION

Referring to the attached drawings, FIG. 1 to FIG. 3, an example of the present invention will be described as follows.

Figure 1:
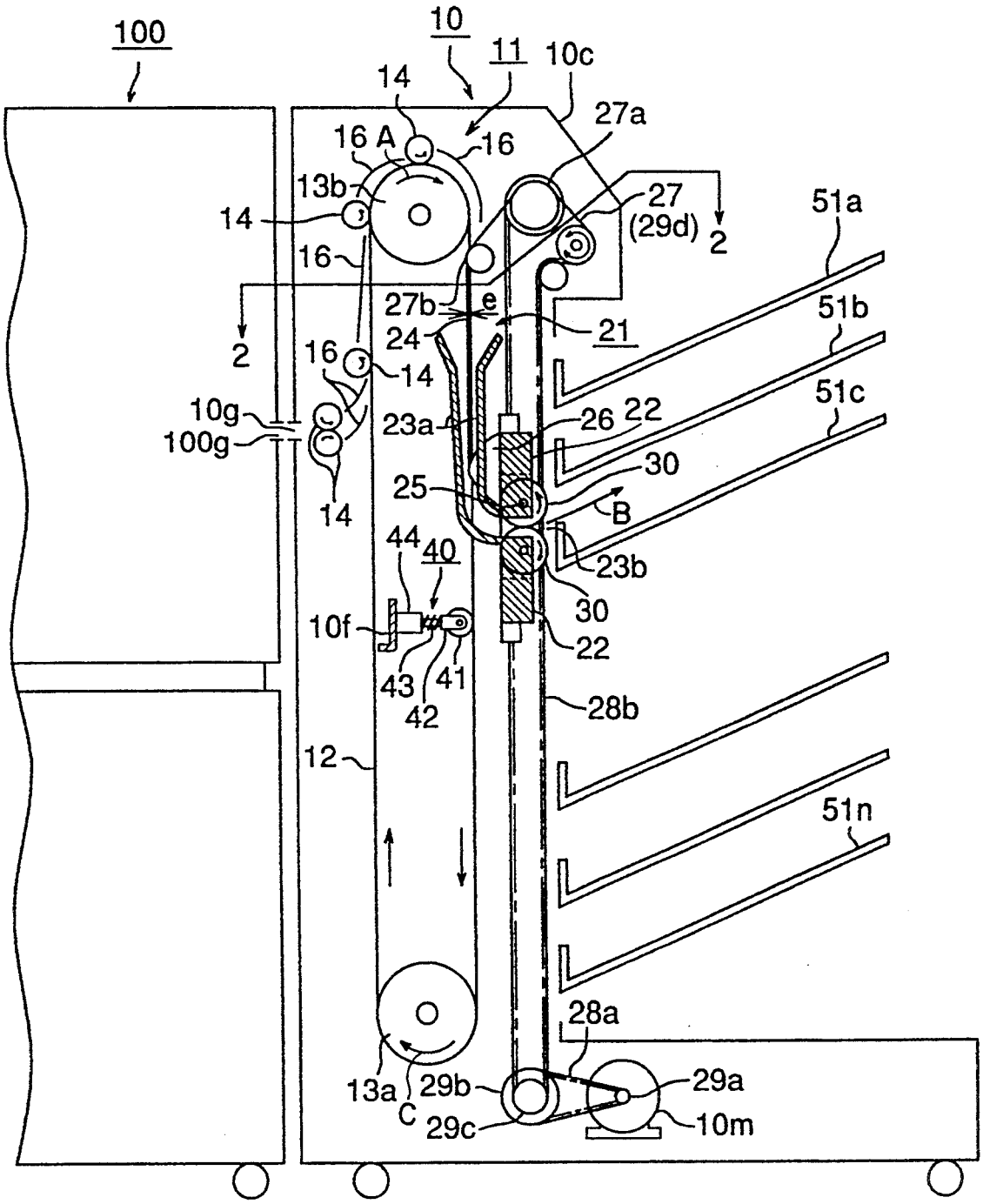
FIG. 1 is a central sectional view according to the present invention.
Figure 2:
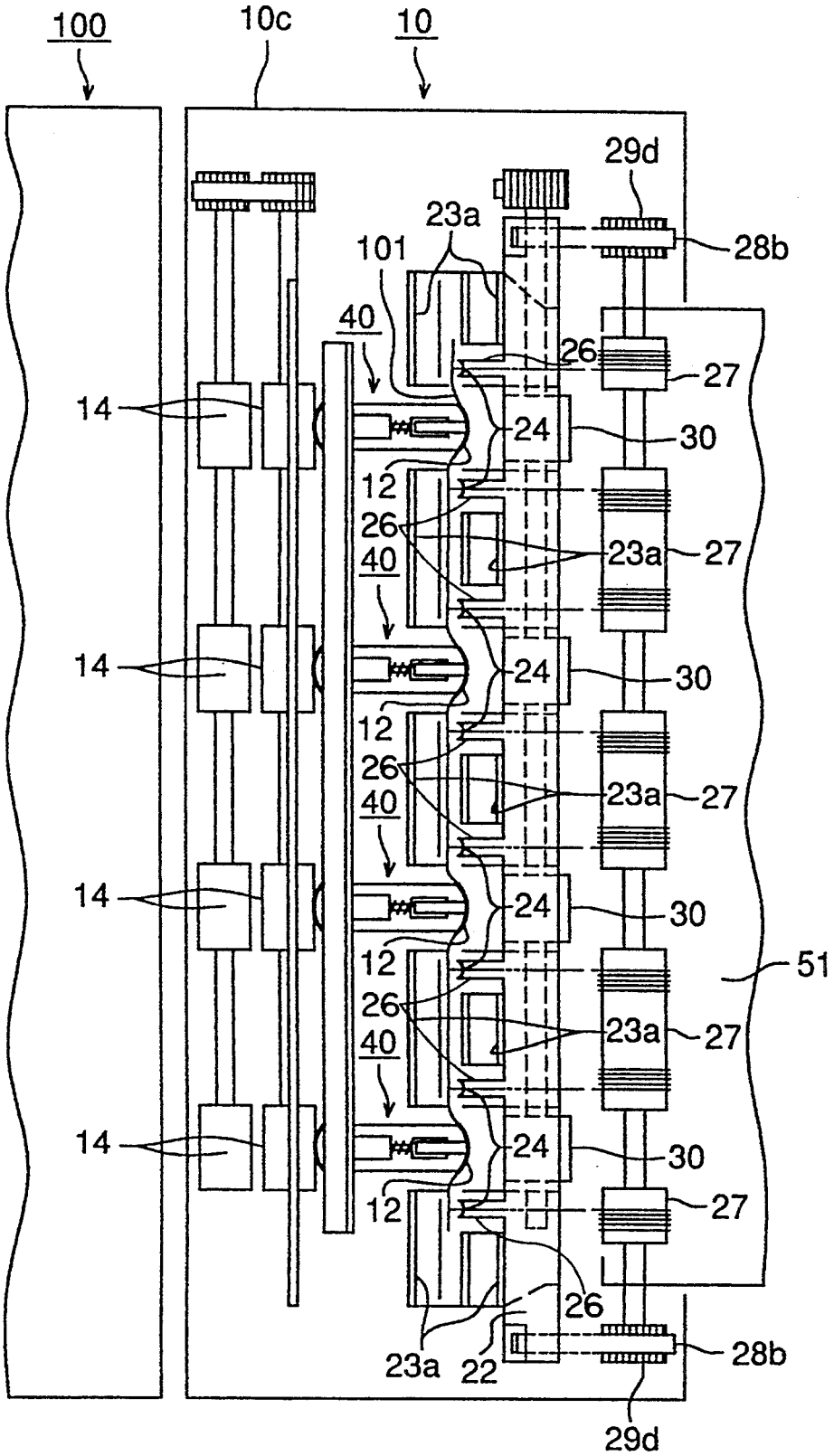
FIG. 2 is a sectional view taken on line X—X of FIG. 1.
Figure 3:
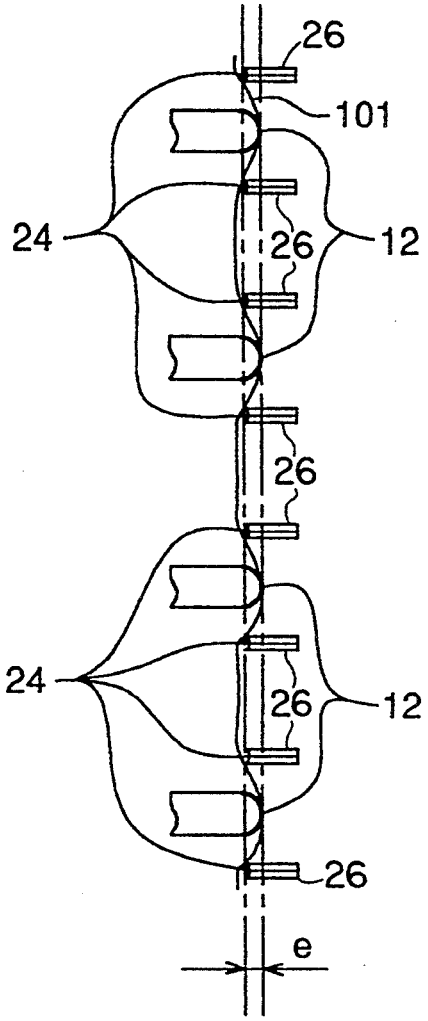
FIG. 3 is a partial view showing the relation among a conveyance belt, a wire, and a sheet.
Figure 4:
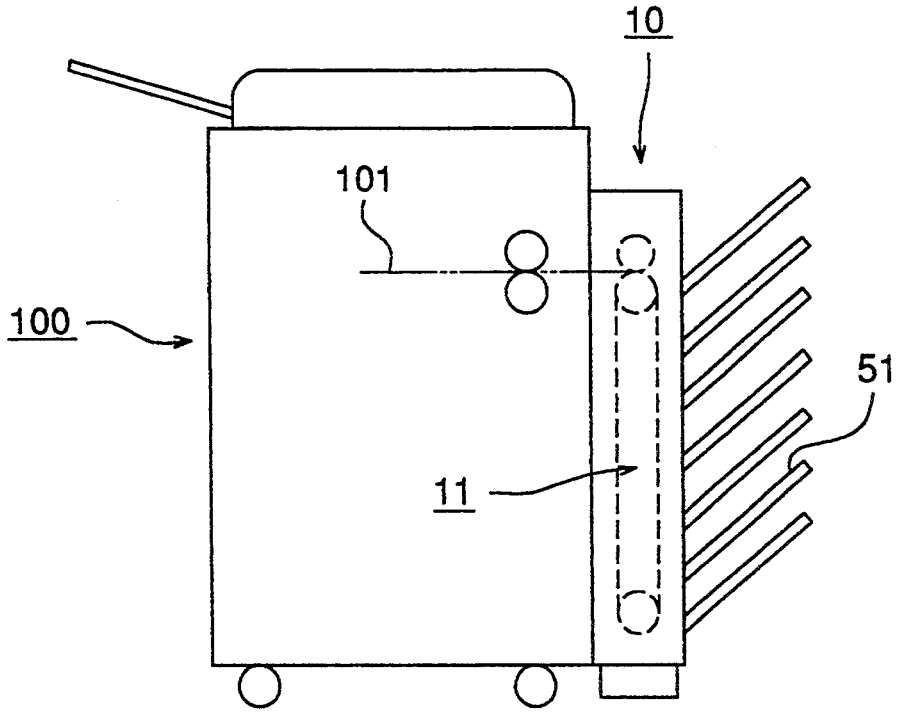
FIG. 4 is a general view showing a combined condition of an image forming apparatus with the sorter.
Figure 5:
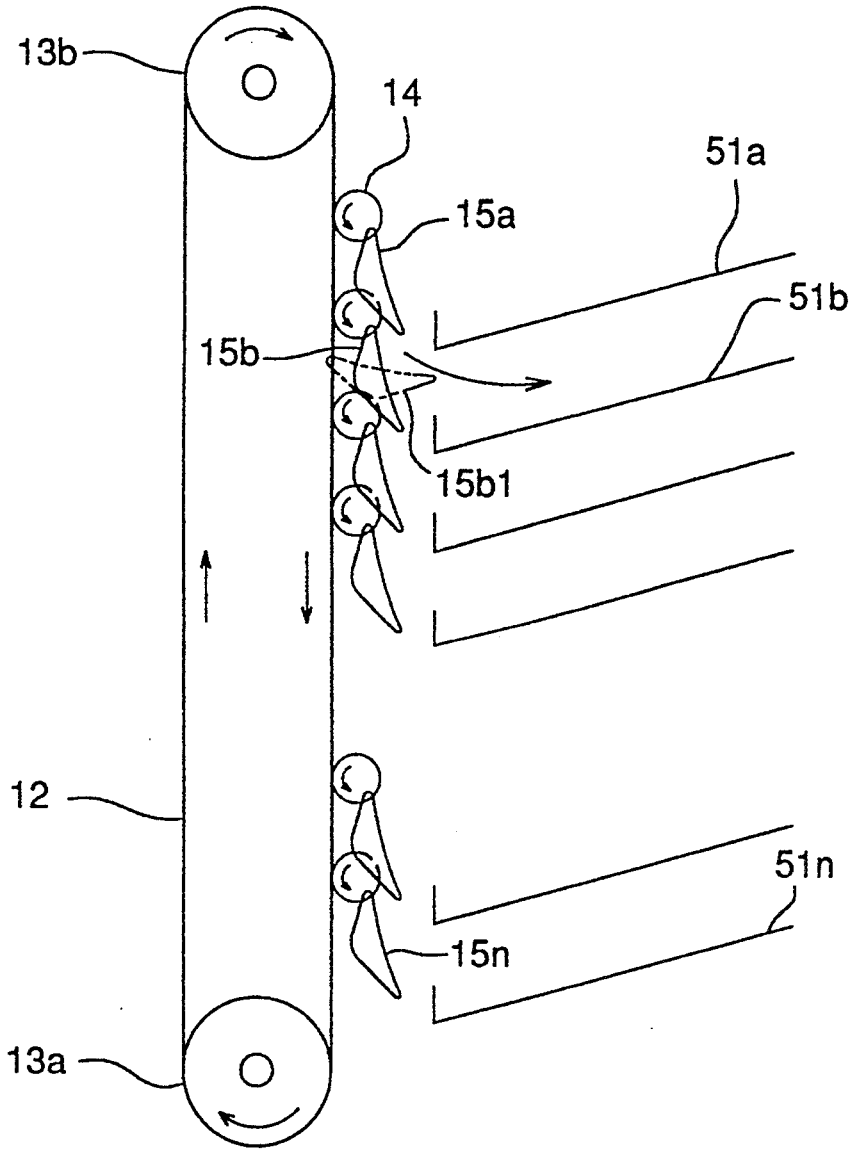
FIG. 5 (PRIOR ART)
FIG. 5 is a view showing a main structure of a conventional switching gate type sorter.
Figure 6:
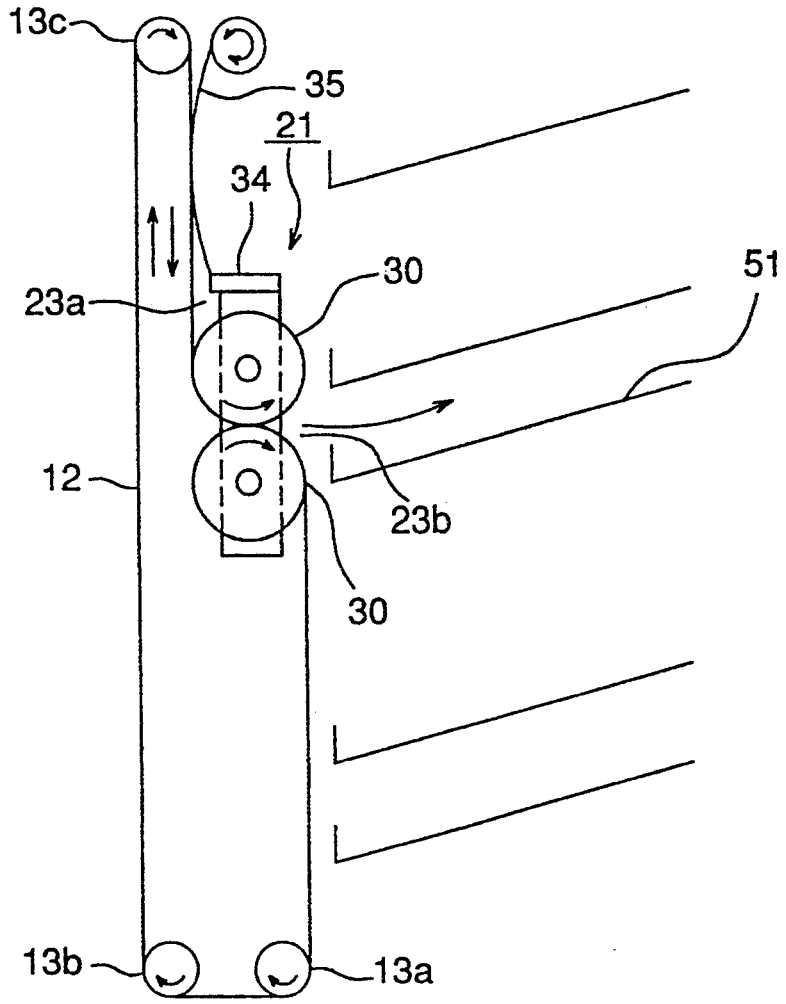
FIG. 6 (PRIOR ART)
FIG. 6 is a view showing a main structure of a conventional distributor type sorter.
Figure 7:
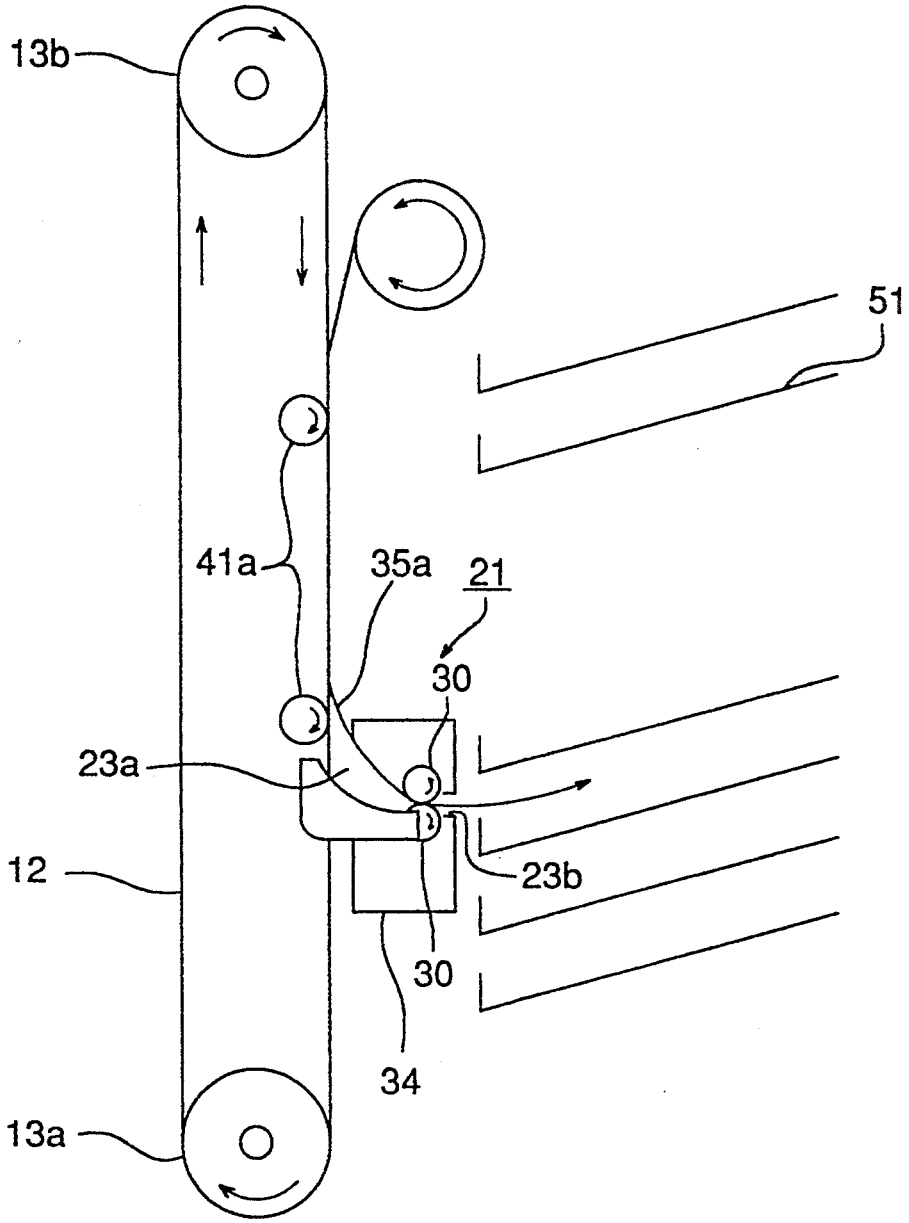
FIG. 7 (PRIOR ART)
FIG. 7 is a view showing a main structure of another conventional distributor type sorter.

FIG. 1 is a central sectional view of an example of a sorter according to the present invention, and FIG. 2 is a sectional view taken on line X—X of FIG. 1.

The sorter of the present invention has a distributor 21, as shown in FIG. 1, which can be reciprocally moved vertically and supported between a row of bins 51 and a conveyance belt 12 provided along an inlet side of the row of plural bins 51.

That is, the bins 51, namely bins 51*a*, 51*b*, 51*c*, . . . 51*n* are provided in a casing of the sorter in a row, each separated by an equal distance, from the upper side by a means not shown in the drawings.

The conveyance belt 12 is supported by belt pulleys 13*a* and 13*b* as shown in the drawings, and is rotated clockwise as shown by arrows A and C in FIG. 1 of the drawing during conveyance. A recording sheet, on which an image is formed by an image forming apparatus 100, is delivered from a sheet delivery port 100*g* of the image forming apparatus, and enters a sheet receiving port 10*g* of the sorter 10. The sheet is guided by a conveyance roller 14 and a guide plate 16 as shown in FIG. 1 and conveyed to a downward movement section provided on the right side of the conveyance belt 12.

The distributor 21, (refer to FIG. 2, also), has a sheet receiving member provided with a receiving port 23*a* which is opened upwardly, and the member is integrally provided to a distributor frame 22. A delivery port 23*b* is provided on the other end of the receiving port 23*a*, and is vertically contacted with a pair of delivery rollers 30 which are located adjoining the port 23*b*. The sheet is delivered from the delivery port 23*b* in the direction of arrow B onto the bin.

In FIG. 1, both ends of a timing belt 28*b* are respectively fixed to the upper end and the lower end of a distributor frame in the longitudinal direction in the manner that the upper end of the distributor frame 22 is pulled upwardly by the timing belt 28*b*, and the lower end of the frame 22 is pulled downwards by the timing belt 28*b*. A timing belt 28*a* is provided between a timing gear 29*a* provided on a shaft of a stepping motor 10*m*, which is a driving motor, and a timing gear 29*b* which is integrally rotated with a timing gear 29*c*, which is a driving gear for the timing belt 28*b*. A rotational shaft of the timing gear 29*b* (29*c*) is extended to a timing gear 29*c* of a timing belt 28*b* provided to the opposite side of the device, and the front timing belt can be integrally driven with the rear timing belt.

A positioning sensor, not shown in the drawing, is provided at a position corresponding to each bin. The stepping motor 10*m* is driven according to the information of the positioning sensor in the manner that the distributor 21 is stopped at a predetermined position with respect to each bin 51.

The timing belt 28*b* (refer to FIG. 2, also), is also provided on a timing gear 29*d* in the upper section of the sorter, and the timing gear 29*d* is coaxially provided with a wire winding pulley 27. The end of a wire 24 wound around the wire winding pulley 27 is provided to one end of a wire spring 25 through pulleys 27*a*, 27*b*, and a wire receiver 26. The other end of the wire spring 25 is hooked to a rotational shaft of a delivery roller 30.

The wire spring 25 gives the wire 24 appropriate tension.

There is no special reason for the other end of the wire spring 25 to be hooked to the rotational shaft of the delivery roller 30, but only because an appropriate shaft, to which the spring is hooked, has been provided there. The other end of the wire spring may be hooked to the distributor frame 22.

As described above, when the distributor 21 is driven vertically by the driving motor 10*m*, the wire winding pulley 27, having the same shaft and the same diameter as that of the timing gear 29*d* which is rotated in the case of the vertical movement of the distributor 21, is rotated. The wire 24 is wound by the wire winding pulley 27, or wound off from the pulley, while maintaining appropriate tension. That is, when the distributor 21 is vertically driven, the wire tension is appropriately maintained irrespective of the position of the distributor 21.

Next, a position of the wire 24 which is in parallel with the conveyance belt 12, will be described as follows.

In FIG. 2, with respect to the longitudinal direction of the distributor frame 22 in the example, four pairs of wires, totally 8 wires 24, are positioned a certain distance apart from four conveyance belts 12 in the manner that each conveyance belt 12 is sandwiched from both sides by two wires as shown in the drawings. Further, the wire 24 is positioned beyond the sheet conveyance surface of the conveyance belt 12 toward the conveyance belt side. FIG. 3 is a partial view showing the foregoing relation, which is given for easy understanding. As shown in FIG. 3, the wire 24 is positioned on an inside surface of the conveyance belt 12 with a dimension e, and thereby, the sheet 101 conveyed by the conveyance belt 12, the conveyance roller 14, and the guide plate 16 as described above, is conveyed by being sandwiched between the conveyance belt 12 and the wire 24, as shown in the drawing, in the manner that the sheet 101 is undulated between them. Therefore, a large and stable conveyance force can be obtained.

Next, a pressing roller unit 40, by which some portions of almost central sections between the shaft of the conveyance belt pulley 13*a* and the shaft of the conveyance belt pulley 13*b* of the conveyance belt 12 is pressed by a light weight from the inside of the conveyance belt 12, on the side of the conveyance belt 12 along which the distributor 21 is moved, in FIG. 1 and FIG. 2, will be described as follows.

In the pressing roller unit 40, a pressing roller 41 is pivotally supported by a C-shaped plate 42, and the shaft of the C-shaped plate is inserted into a base 44 provided in the sorter frame 10*f*, while a pressing spring 43 is being sandwiched between them. Although a rotational shaft of the pressing roller 41 is not shown in the drawings, the shaft is structured to be provided in parallel with the shafts of pulleys 13*a*, and 13*b* of the conveyance belt.

Further, the pressing force of the pressing roller unit 40 to press the conveyance belt 12 from its inside, is not more than a resiliency a resiliencey force that is created as the belt 12 is deflected by the stiffness of the sheet when the conveyance direction of the sheet is changed by the distributor 21. By this structure, even if the conveyance direction of the sheet is changed about 90 degrees at the distributor 21 while it is nipped between the belts 12 and the wires 24, the sheet is neither wrinkled nor torn.

When the conveyance belt 12 is pressed from its inside by the pressing roller unit 40 by the above-described light weight, the following advantages can be obtained in the case where the conveyance direction of the sandwiched sheet is changed by the distributor 21. When the conveyance belt 12 is deflected by the stiffness of the sheet, stresses are not placed on the sheet, and therefore, wrinkles and folds are not caused on the sheet, and the sheet can be stably conveyed.

According to the present invention, a sorter can be provided in which: the conveyance force of the sheet is always large so that the sheet can be stably conveyed; the sheet is not electrostatically charged by the conveyance of the sheet; it is not necessary to provide complicated structures by which the pressing force to press the conveyance belt from its inside is removed; the structure of the apparatus is simple; the apparatus does not fail; and the cost is low.

What is claimed is:

1. A sorter for distributing a plurality of sheets to sheet holding bins, comprising:

a plurality of sheet holding bins for holding a plurality of sheets, said plurality of sheet holding bins each having inserting portions, said inserting portions being aligned in a first line in a predetermined direction;

a resilient conveyance belt arranged to convey said plurality of sheets along a second line that is parallel and adjacent to said first line;

a distributor having end portions, said distributor being reciprocally movable along said second line, for distributing said plurality of sheets to said plurality of sheet holding bins;

moving means for reciprocally moving said distributor along said second line, said moving means including:

a belt member having two end portions, each end portion of the belt member being attached to a respective one of the end portions of said distributor;

driving apparatus for driving said belt member so as to reciprocally move said distributor; and a wire member suspended between said distributor and a winding device for guiding said sheets;

the winding device winding and unwinding the wire member so that the wire member has a predetermined tension between the distributor and the winding device;

wherein said resilient conveyance belt conveys the plurality of sheets while said wire member and the resilient conveyance belt nip each of the plurality of sheets; and urging means for urging said resilient conveyance belt from one surface side thereof, that is opposite to another surface side thereof, to convey said plurality of sheets on said resilient conveyance belt in a direction toward said inserting portions of said plurality of sheet holding bins.

2. The sorter of claim 1, wherein said urging means is located in a vicinity of a center portion of said resilient conveyance belt on said one surface side, that is opposite to said another surface side, to convey said plurality of sheets, of said resilient conveyance belt.

3. The sorter of claim 1, wherein said urging means produces a pressing force against said one surface side, that is opposite to said another surface side, to convey said plurality of sheets of said resilient conveyance belt, said pressing force being not more than a deflecting force created by a resiliency of said resilient conveyance belt when said resilient conveyance belt is deflected by a stiffness of said plurality of sheets as a conveyance direction of said plurality of sheets is changed by said distributor.

4. A sorter for distributing a plurality of sheets to sheet holding bins, comprising:

a plurality of sheet holding bins for holding a plurality of sheets, said plurality of sheet holding bins each having inserting portions, said inserting portions being aligned in a first line in a predetermined direction;

a resilient conveyance belt arranged to convey said plurality of sheets along a second line that is parallel and adjacent to said first line;

a distributor having end portions, said distributor being reciprocally movable along said second line, for distributing said plurality of sheets to said plurality of sheet holding bins;

moving means for reciprocally moving said distributor along said second line, said moving means including:

a belt member having two end portions, each end portion of the belt member being attached to a respective one of the end portions of said distributor;

driving apparatus for driving said belt member so as to reciprocally move said distributor; and a wire member suspended between said distributor and a winding device for guiding said sheets;

the winding device winding and unwinding the wire member so that the wire member has a predetermined tension between the distributor and the winding device;

wherein said resilient conveyance belt conveys the plurality of sheets while said wire member and the resilient conveyance belt nip each of the plurality of sheets; and a driver for driving both said driving apparatus and said winding device, said driver including a rotatable shaft coupled to drive both said driving apparatus and said winding device.

5. A sorter for distributing a plurality of sheets to sheet holding bins, comprising:

a plurality of sheet holding bins for holding a plurality of sheets, said plurality of sheet holding bins each having inserting portions, said inserting portions being aligned in a first line in a predetermined direction;

a resilient conveyance belt arranged to convey said plurality of sheets along a second line defined to be parallel and adjacent to said first line;

a distributor having end portions, said distributor being reciprocally movable along said second line, for distributing said plurality of sheets to said plurality of sheet holding bins;

moving means for reciprocally moving said distributor along said second line, said moving means including:

a belt member having two end portions, each end portion of the belt member being attached to a respective one of the end portions of said distributor;

driving apparatus for driving said belt member so as to reciprocally move said distributor; and a wire member suspended between said distributor and a winding device for guiding said sheets;

said wire member being positioned along a third line that is parallel and adjacent to said second line where said wire member and said resilient conveyance belt nip each of said plurality of sheets; and said second line being closer to said first line than said third line, said wire member being arranged to cross a plane in which said second line is defined so that when one of said plurality of sheets is being conveyed by said resilient conveyance belt, the wire member crosses said plane in which the second line is defined to nip said one sheet between said wire member and said resilient conveyance belt;

the winding device winding and unwinding the wire member so that the wire member has a predetermined tension between the distributor and the winding device;

wherein said resilient conveyance belt conveys the plurality of sheets while said wire member and the resilient conveyance belt nip each of the plurality of sheets.

6. The sorter of claim 5, further comprising a driver for driving both said driving apparatus and said winding device wherein said driver includes a rotatable shaft coupled to drive both said driving apparatus and said winding device.

* * * * *